US011814814B2

(12) United States Patent
Tripathi et al.

(10) Patent No.: US 11,814,814 B2
(45) Date of Patent: Nov. 14, 2023

(54) HYDRAULIC SYSTEM FOR HYDRO-MECHANICAL MACHINES COMPRISING ROTARY MECHANISM AND BOOM CYLINDER

(71) Applicant: L&T TECHNOLOGY SERVICES LIMITED, Chennai (IN)

(72) Inventors: Atul Chandra Tripathi, Noida (IN); Shailendra J Shrivastava, Bangalore (IN)

(73) Assignee: L&T TECHNOLOGY SERVICES LIMITED, Chennai (IN)

( * ) Notice: Subject to any disclaimer, the term of this patent is extended or adjusted under 35 U.S.C. 154(b) by 0 days.

(21) Appl. No.: 17/720,349

(22) PCT Filed: Mar. 18, 2020

(86) PCT No.: PCT/IB2020/052443
§ 371 (c)(1),
(2) Date: Apr. 14, 2022

(87) PCT Pub. No.: WO2021/090076
PCT Pub. Date: May 14, 2021

(65) Prior Publication Data

US 2022/0397133 A1 Dec. 15, 2022

(30) Foreign Application Priority Data

Nov. 6, 2019 (IN) ..... 201941045055

(51) Int. Cl.
*E02F 9/22* (2006.01)
*F15B 1/02* (2006.01)
(Continued)

(52) U.S. Cl.
CPC ..... *E02F 9/2217* (2013.01); *E02F 9/2203* (2013.01); *F15B 1/024* (2013.01);
(Continued)

(58) Field of Classification Search
CPC .. F15B 1/024; F15B 21/14; F15B 2211/7135; E02F 9/2217
See application file for complete search history.

(56) References Cited

U.S. PATENT DOCUMENTS 8,919,113 B2 * 12/2014 Ma ..... E02F 9/2217 60/416
9,290,912 B2 * 3/2016 Wen ..... E02F 9/2217
(Continued)

*Primary Examiner* — Michael Leslie

(57) ABSTRACT

This disclosure relates to a hydraulic system for a hydro-mechanical machine comprising a rotary mechanism and a boom cylinder The hydraulic system includes a primary accumulator configured to receive and store high-pressure fluid in response to starting and stopping of the rotary mechanism. A control system configured to enable passage of the high-pressure fluid stored in the primary accumulator to a rotary control valve configured to control the rotary mechanism, and a boom control valve configured to control the boom cylinder through the hydraulic supply circuit, based on a predefined pressure threshold associated with the primary accumulator. A secondary accumulator coupled to the primary accumulator and the control system via the hydraulic supply circuit is configured to store surplus high-pressure fluid provided by the primary accumulator through the hydraulic supply circuit.

15 Claims, 1 Drawing Sheet

(51) Int. Cl.
*F15B 21/14* (2006.01)
*F15B 15/22* (2006.01)

(52) U.S. Cl.
CPC ..... *F15B 15/22* (2013.01); *F15B 21/14* (2013.01); *F15B 2211/20576* (2013.01); *F15B 2211/6306* (2013.01); *F15B 2211/7135* (2013.01); *F15B 2211/761* (2013.01)

(56) References Cited

U.S. PATENT DOCUMENTS

| | | | | |
|---|---|---|---|---|
| 9,388,829 | B2 * | 7/2016 | Zhang | F15B 21/14 |
| 9,556,591 | B2 * | 1/2017 | Shang | E02F 9/2217 |
| 9,809,958 | B2 * | 11/2017 | Shang | E02F 9/2228 |
| 9,951,795 | B2 * | 4/2018 | Shang | E02F 9/2217 |
| 11,118,604 | B2 * | 9/2021 | Chandra Tripathi | E02F 9/2217 |

* cited by examiner

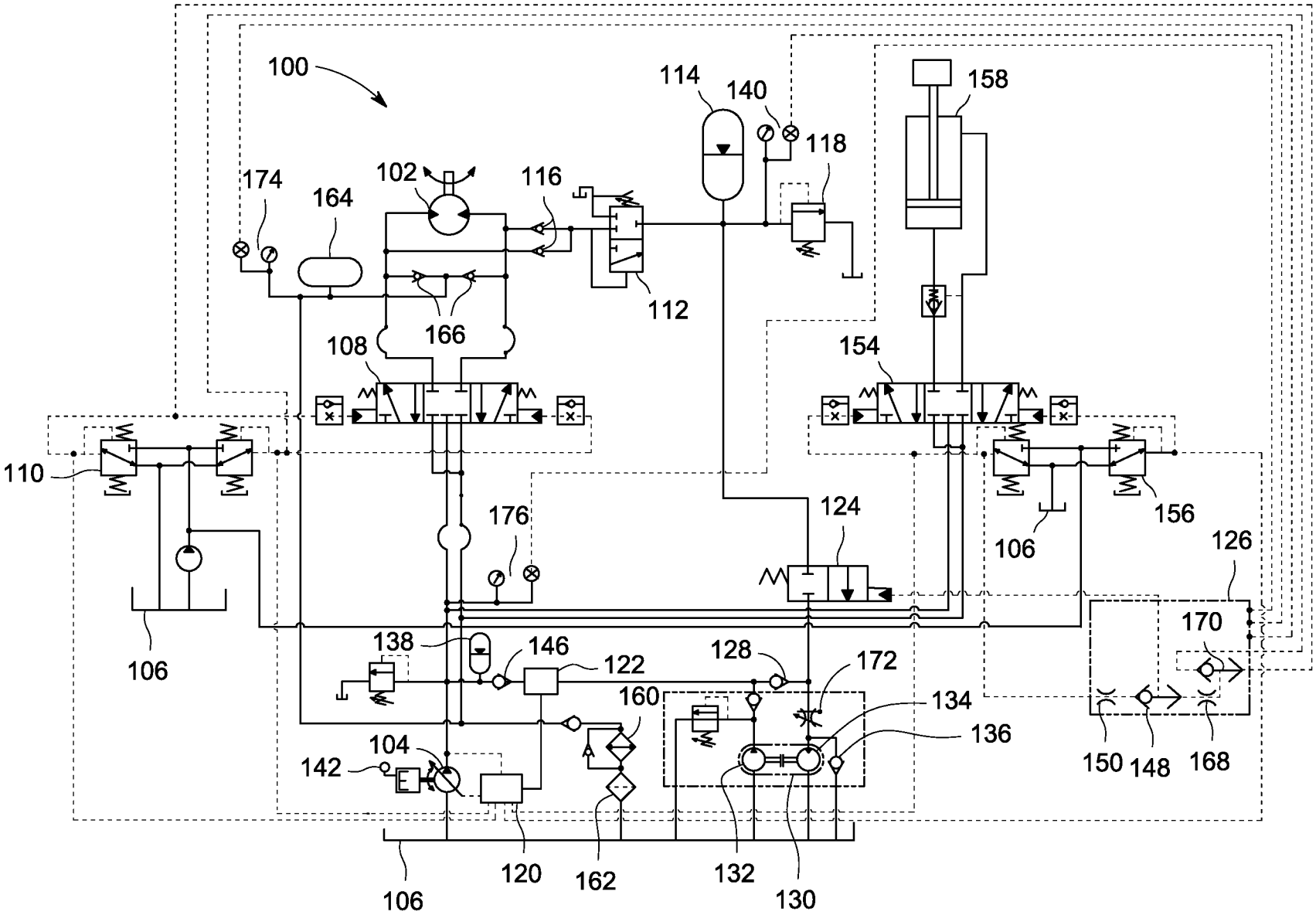
100
102
104
106
108
110
112
114
116
118
120
122
124
126
128
130
132
134
136
138
140
142
144
146
148
150
154
156
158
160
162
164
166
168
170
172
174
176

HYDRAULIC SYSTEM FOR HYDRO-MECHANICAL MACHINES COMPRISING ROTARY MECHANISM AND BOOM CYLINDER

TECHNICAL FIELD

This disclosure relates generally to hydro-mechanical machines, and more particularly to hydraulic system for hydro-mechanical machines comprising rotary mechanism and boom cylinder.

BACKGROUND

Hydro-mechanical machines, especially construction machines, such as, excavators use multiple hydraulic actuators to accomplish a variety of tasks. The actuators are fluidly connected to a pump that provides pressurized fluid to operate the actuators and a work tool that is further connected to the actuators. Once hydraulic energy of the pressurised fluid is utilized, pressurized fluid is returned to a low-pressure reservoir. Usually the fluid being drained is at a higher pressure, when compared with the pressure in the low-pressure reservoir. Thus, the remaining energy in the fluid is wasted once it enters the low-pressure reservoir. This wasted energy reduces the efficiency of the entire hydro-mechanical machine over a course of machine duty cycle. By way of an example, in an excavator, energy loss is caused due to a swing drive, where the fluid at high pressure is relived through a cross port relief valve to a low-pressure reservoir, during start of acceleration and retardation or braking of the swing motion. By way of another example, a boom system may waste energy during lowering of arm components.

The energy loss in such hydro-mechanical machines is due to opening of port relief valves of swing motor during acceleration under heavy load and braking during swift and short rotation cycle of 30° to 180°, where the rotation is stopped with high braking force. This results in conversion of kinetic energy into heat energy. Such loss of energy not only results in efficiency loss but also affect components due to heat dissipation.

There is therefore, need for a hydraulic system in a hydro-mechanical machine, which reuses such loss of energy and increases overall efficiency of the hydro-mechanical machine.

SUMMARY

In an embodiment, a hydraulic system for a hydro-mechanical machine comprising a rotary mechanism and a boom cylinder is disclosed. The hydraulic system includes a primary accumulator configured to receive and store high-pressure fluid being relieved over port relief valves of rotary mechanism during acceleration under heavy load and also in response to stopping of the rotary mechanism. The hydraulic system further includes a control system coupled to the primary accumulator through a hydraulic supply circuit, wherein the control system is configured to enable passage of the high-pressure fluid stored in the primary accumulator to a rotary control valve configured to control the rotary mechanism, or different control valves to control different actuators of hydro-mechanical machine (or a boom control valve configured to control the boom cylinder) through the hydraulic supply circuit, based on a predefined pressure threshold associated with the primary accumulator. The hydraulic system includes a secondary accumulator coupled to the primary accumulator and the control system via the hydraulic supply circuit, wherein the secondary accumulator is configured to store surplus high-pressure fluid provided by the primary accumulator through the hydraulic supply circuit.

In another embodiment, a hydraulic system for a hydro-mechanical machine comprising a rotary mechanism and a boom cylinder is disclosed. The hydraulic system includes a primary accumulator configured to receive high-pressure fluid being relieved over port relief valves of rotary mechanism during acceleration under heavy load and also in response to stopping of the rotary mechanism, temporarily store the high-pressure fluid, and provide the high-pressure fluid to a rotary control valve configured to control the rotary mechanism and to a boom control valve configured to control the boom cylinder through a hydraulic supply circuit, based on a predefined pressure threshold associated with the primary accumulator. The high-pressure fluid stored in the primary accumulator is also supplied to boom control valve or other control valves to control boom cylinder or other hydraulic actuators as required. The hydraulic system further includes a secondary accumulator coupled to the primary accumulator via the hydraulic supply circuit. The secondary accumulator is configured to store surplus high-pressure fluid provided by the primary accumulator in the hydraulic supply circuit and supply in case of deficit.

In yet another embodiment, a hydraulic system for an off-highway machine comprising a swing motor and a boom cylinder is disclosed. The hydraulic system includes a primary accumulator configured to receive and store high-pressure fluid being relieved over port relief valves of the swing motor during acceleration under heavy load and also in response to stopping of the swing motor. The hydraulic system further includes a control system coupled to the primary accumulator through a hydraulic supply circuit, wherein the control system is configured to enable passage of the high-pressure fluid stored in the primary accumulator to a rotary control valve configured to control the swing motor, or different control valves and their connected hydraulic actuators of hydro-mechanical machine (or a boom control valve configured to control the boom cylinder) through the hydraulic supply circuit, based on a predefined pressure threshold associated with the primary accumulator. The hydraulic system includes a secondary accumulator coupled to the primary accumulator and the control system via the hydraulic supply circuit, wherein the secondary accumulator is configured to store surplus high-pressure fluid provided by the primary accumulator through the hydraulic supply circuit and supply in case of deficit.

It is to be understood that both the foregoing general description and the following detailed description are exemplary and explanatory only and are not restrictive of the invention, as claimed.

BRIEF DESCRIPTION OF THE DRAWINGS

The accompanying drawing, which are incorporated in and constitute a part of this disclosure, illustrate exemplary embodiments and, together with the description, serve to explain the disclosed principles.

FIG. 1 illustrates a hydraulic supply circuit for a hydro-mechanical machine that includes a rotary mechanism, a boom cylinder, and uses positive flow control or negative flow control pumps systems, in accordance with an embodiment.

DETAILED DESCRIPTION

Exemplary embodiments are described with reference to the accompanying drawing. Wherever convenient, the same reference numbers are used throughout the drawing to refer to the same or like parts. While examples and features of disclosed principles are described herein, modifications, adaptations, and other implementations are possible without departing from the spirit and scope of the disclosed embodiments. It is intended that the following detailed description be considered as exemplary only, with the true scope and spirit being indicated by the following claims.

Referring now to FIG. 1, a hydraulic supply circuit 100 for a hydro-mechanical machine (not shown in FIG. 1) that includes a rotary mechanism 102, a boom cylinder 158 and uses positive flow control or negative flow control pumps systems is illustrated, in accordance with an embodiment. The hydro-mechanical machine, for example, may be an off-highway machine, an excavator, a truck mounted crane, a rough terrain crane, a slew crane, a knuckle boom crane, a crawler crane, a pipe layers, a boom lift, and an aerial work platform. The hydro mechanical machine includes a primary pump system 104, which may be a variable displacement pump or a fixed displacement pump. Examples of the variable displacement pump may include, but are not limited to a load sensing type pump of open center or closed center type, a positive flow control pump, or a negative flow control pump, or any other type of variable displacement pump operating in open loop or closed loop hydraulic system or any other configuration in hydro-mechanical machines that include the rotary mechanism 102. The hydraulic supply circuit 100 includes a hydraulic arrangement for the primary pump system 104 in open loop circuit that uses positive flow control or negative flow control. It may be noted that the hydraulic supply circuit 100 may be used for systems that include two or more pumps systems. A high-pressure fluid from a primary accumulator 114 may be supplied to a rotary control valve 108, a boom control valve 154 or to other control valves, and further to their respective hydraulic actuators. It will be apparent to a person skilled in the art that an additional embodiment may include, but is not limited to variable displacement pump fitted in any type of hydraulic circuit, in with open loop/closed loop circuit configuration, or the fixed displacement pump, used in any type of the hydraulic supply circuit 100 of the hydro-mechanical machine that may include rotary mechanisms, boom cylinders or other types of hydraulic actuators.

The primary pump system 104 is connected to a fluid reservoir 106 that includes a fluid. Examples of the fluid, may include, but are not limited to oil or water. The fluid reservoir 106 is configured to supply the fluid to the rotary mechanism 102 through a rotary control valve 108, thereby enabling the rotary mechanism 102 to provide a rotary swing movement to a connected work tool. By way of an example, in an off-highway machine, the connected work tool may be an excavating boom, arm, bucket with associated mechanism and the rotary
mechanism 102 may be a swing hydraulic motor or any other kind of rotary motor, for example, track motor or wheel hydraulic motor.

The rotary control valve 108 may be controlled by a swing controller 110. Examples of the swing controller 110 may include, but are not limited to a joystick, electronic controller, computer controller, a mobile device controller, or any other type of existing controller. An operator may engage or use the swing controller 110 to control functioning of the rotary mechanism 102. When the swing controller 110 is operated to rotate the rotary mechanism 102 in a desired direction, a pilot pressure is applied to the rotary control valve 108. The pilot pressure may vary between a predefined range, for example, but not limited to 0 to 50 bars. In response to the pilot pressure, the passage of supply of the fluid in the rotary control valve 108 is opened and the fluid is supplied through the primary pump system 104 that in turn rotates the rotary mechanism 102 in a desired direction.

In an embodiment, the pilot pressure supplied to the rotary control valve 108 and the direction of supply of the fluid depends upon an angular movement of the swing controller 110. In response to receiving a start signal from the swing controller 110, the rotary control valve 108 may open the fluid supply from the primary pump system 104 to the rotary mechanism 102 in a desired direction. The rotary mechanism 102 in turn may rotate a required component (for example, a connected work tool) of the hydro-mechanical machine. A start command may be provided by the swing controller 110 to accelerate the rotary mechanism 102 from a rest position. In this case, initially a pressure may build up at the rotary mechanism 102 as the rotation is not enough. Further, a regenerative valve 112 may open in order to allow high pressure fluid into the primary accumulator 114. Similarly, in response to receiving a stop signal from the swing controller 110, the rotary control valve 108 may close the fluid supply from the primary pump system 104 to the rotary mechanism 102.

However, the rotary mechanism 102 may keep on rotating due to inertia of the component of the hydro-mechanical machine. In other words, the rotary mechanism 102 may act as a pump and may enable pressure to build up on the downstream side of the rotary mechanism 102. The high-pressure build up on the downstream side of the rotary mechanism 102 may enable opening of the regenerative valves 112. It will be apparent to a person skilled in the art that the hydro-mechanical machine may include multiple regenerative valves in a series or parallel combination to each other. The regenerative valve 112 may divert the high-pressure fluid received as a result of starting or stopping of the rotary mechanism 102 to a primary accumulator 114. The primary accumulator 114 may store the high-pressure energy in the high-pressure fluid, which is received through the regenerative valve 112, in the form of hydraulic energy.

In hydro mechanical machines that use the rotary mechanism 102, an inlet of anti-cavitation valves 166 may be connected to a tank line of one or more of the rotary control valve 108, the boom control valve 154, and other control valves, which may receive return fluid exiting from different mechanisms or hydraulic actuators. The fluid exiting from a tank line of the rotary control valve 108, the boom control valve 154 and other control valves passes to the fluid reservoir 106 (tank) through a check valve a heat exchanger 160, and a filter 162. This cools and filters returning fluid and also maintains positive pressure in the tank line. A positive pressure may be applied to the inlet of anti-cavitation valves 166 for preventing cavitation of the rotary mechanism 102 or the swing motor 102, when the rotary mechanism 102 or the swing motor 102 act as a pump during braking. According to an embodiment, a pressurized tank 164 may be connected to a line joining the inlet of the anti-cavitation valves 166 (at suction of the anti-cavitation valves 166) to the tank line of the rotary control valve 108, the boom control valve 154, and other control valves. This enables provision of a positive suction pressure at the rotary mechanism 102 or the swing motor 102. According to another embodiment, a charging pump, (for example, a positive displacement type pump, a centrifugal pump or any other fluid source) or a flexible bellow (metallic or wire braided elastomer) which can expand and hold oil under high pressure and contract and release when there is demand, may be connected to the line joining the inlet of the anti-cavitation valves 166 to the tank line of the rotary control valve 108, the boom control valve 154, and the other control valves. Subsequently, an oil supply may be provided for suction during the braking or de-acceleration, whenever the rotary mechanism 102 or the swing motor acts as the pump. It should be noted that the flexible bellow may expand or contract in order to hold oil under high or low pressure according the requirement. A second pressure transducer 174 (or pressure gauge/indicator) is provided in a suction line of the anti cavitation valves 166 that measures and indicates pressure and accordingly warns the operator, when the pressure falls below a pre-defined threshold pressure value (positive pressure threshold). It should be noted that a minimum threshold pressure value may be selected from a range of 1 to 3 bar.

In an embodiment, the primary accumulator 114 may be pre-charged with an inert gas and may store the fluid at high pressure. Examples of the inert gas may include, but are not limited to nitrogen, or argon. The primary accumulator 114 may be one of a rubber bladder type accumulator, a piston type accumulator, a diaphragm type accumulator, a spring loaded type accumulator, or another type of accumulator. Additionally, the hydraulic supply circuit 100 may include a set of check valves 116, which is configured to check the back flow of the fluid from the primary accumulator 114 to the rotary mechanism 102 (for example, a swing motor). In an embodiment, the primary accumulator 114 may also include an accumulator relief valve 118 that is configured to limit or control the maximum fluid pressure in the primary accumulator 114.

The hydraulic supply circuit 100 may further include a pump controller 120 that is configured to control the primary pump system 104. The pump controller 120 may vary the displacement of the primary pump system 104 based on actuation of the swing controller 110, the boom controller 156 or any other controllers present in the system, based on a flow required by the rotary mechanism 102, the boom cylinder 158, or other connected mechanisms, and based on availability of the fluid supply from the primary accumulator 114.

According to an embodiment, the pump controller 120 may get a signal from one or more of the swing controller 110, the boom controller 156, and other controllers of the hydro-mechanical machine, sensing of pressure at outlet of the primary pump system 104, or a flow sensing arrangement 122 of fluid flow as measured in a supply line, which gives indication of fluid supply from the primary accumulator 114 and the quantity of flow rate. Accordingly, the flow sensing arrangement 122 gives hydraulic oil supply feedback to the pump controller 120 and the primary pump system 104 in order to reduce displacement and thereby flow from the primary pump system 104 by an amount which is same as the amount of fluid flow supplied by the primary accumulator 114. The flow sensing arrangement 122 may be of differential pressure sensing arrangement or any other type of flow sensing arrangement.

The pump controller 120 may control the flow of the primary pump system 104, based on operation of the swing controller 110, the boom controller 156, or the other controllers, in order to supply fluid to the rotary control valve 108, and the boom control valve 154. Consequently, the rotary mechanism 102 starts rotation, or the boom cylinder 158 starts lifting, and the other connected mechanisms start their respective operations to which the fluid is supplied. Additionally, the pump controller 120 may control pressure at outlet of the primary pump system 104, decrease or increase displacement and flow rate of the primary pump system 104, based on flow demand of the rotary mechanism 102, the boom cylinder 158 or the other connected mechanisms and also control the fluid supply based on the feedback received from the flow sensing arrangement 122, which indicates fluid flow from the primary accumulator 114.

It should be noted that when the primary accumulator 114 supplies the high pressure fluid via a direction control valve 124, the flow of the primary pump system 104 may be reduced by reducing an engine speed to deliver less pump flow and to maintain same cumulative flow as in the hydro-mechanical machines in which there is no supply from the primary accumulator 114. The engine speed may be reduced by reducing fuel supply to the engine by a throttle lever (not shown in FIG. 1). According to another embodiment, in the hydro-mechanical machine, where the primary accumulator 114 supplies a pressurized fluid, the engine and the primary pump system 104 of lesser capacity may be used for the same work. The hydraulic system includes a speed control arrangement for modifying an engine speed and a pump speed, in order to modify the flow from the primary pump system 104.

The primary accumulator 114 may supply the stored fluid through the direction control valve 124. The direction control valve 124, for example, may include, but is not limited to a pilot hydraulic operated or solenoid operated on/off or proportional or any other type. The supply of the fluid from the primary accumulator 114 to the rotary control valve 108, the boom control valve 154, and the other control valves of hydro-mechanical machine may be initiated and controlled by the swing controller 110 and the boom controller 156, which in turn feeds to a control system 126 for actuation of the direction control valve 124. The control system 126 may include a set of shuttle valves 148 and 170 and a set of flow restrictors 150 and 168 to supply fluid to the direction control valve 124. The commands from the swing controller 110 and the boom controller 156 or other controllers may also be supplied directly to the direction control valve 124. This may open a passage from the primary accumulator 114 to a pump discharge line, when a command signal is generated by the swing controller 110 for rotating the rotary mechanism 102 or by the boom controller 156 for lifting of the boom cylinder 158. The swing controller 110, the boom controller 156, and the control system 126 may further include, but is not limited to pilot operated hydraulic controls (as shown in FIG. 1) that may work based on pressure actuation by sensing oil supply by the rotary control valve 108, the boom control valve 154, the other control valves and may work by a solenoid operated control, an electro-hydraulic control, an electronic control unit, or a microprocessor based computer control.

In an embodiment, when the swing controller 110, the boom controller 156 and the other controllers are operated to rotate the rotary mechanism 102, to lift the boom cylinder 158 and to actuate other mechanisms, respectively, the direction control valve 124 may be actuated to open the fluid supply from the primary accumulator 114. The fluid may be supplied directly to the rotary control valve 108, the boom control valve 154 or to the other control valves of the hydro-mechanical machine, by opening a check valve 128 and the check valve 146 in free flow direction and through a secondary pump system 130. The primary accumulator 114 supplies the stored fluid according to the requirement of different actuators like during the acceleration of the rotary mechanism 102 or the lifting of the boom cylinder 158.

According to one embodiment, (as shown in FIG. 1), when the hydro mechanical machine uses only the primary pump system 104 for supplying fluid, then the operator commands the swing controller 110 and the boom controller 156 to rotate the rotary mechanism 102 and lift the boom cylinder 158, and the pilot pressure also goes. This enables sensing of pilot pressure by the set of shuttle valves 148 and 170 and the set of flow estrictors 150 and 168. The sensed pilot pressure is further fed to the direction control valve 124. That may open the passage of fluid upon receiving the sensed pilot pressure for the rotary control valve 108 and the boom control valve 154. It will be apparent to the person skilled in the art, that stored high pressure fluid in the primary accumulator 114 may be supplied to the actuators according to the requirement. The set of shuttle valves 148 and 170 and the set of flow restrictors 150, 168 of the control system 126 may receive pilot actuation signals for sensing the pilot pressure transmitted by different controllers like the boom controller 156 or the swing controller 110. Subsequently, the sensed pilot pressure may be further supplied to the direction control valve 124 intending to supply fluid from the primary accumulator 114 to the outlet of the primary pump system 104 of hydra-mechanical machine. It should be noted that each of the set of flow restrictors 150 and 168 may be temperature compensated that controls the fluid flow independent of temperature variation of the fluid. Further, each of the set of flow restrictors 150 and 168 may be selected based on different aspects like viscosity variation, density change or related to any other physical property of the fluid.

It should be noted, the large size hydro-mechanical machines may use two or more primary pump systems (such as, the primary pump system 104), running at same speed, driven by an engine. For such type of hydro-mechanical machines, the stored fluid from the primary accumulator 114 may be supplied to outlet of the two or more primary pumps systems as required, through two or more direction control valves (for example, the direction control valve 124). The secondary pump system 130 may include a hydraulic pump 132 that is mechanically driven by a hydraulic motor 134. The hydraulic motor 134 may convert hydraulic energy of the fluid received from the primary accumulator 114 to mechanical energy. This mechanical energy may be used to run the hydraulic pump 132, which converts medium pressure energy of the fluid in the primary accumulator 114 to high pressure energy, which would be sufficient to feed to the rotary control valve 108, the boom control valve 154, or to the other control valves of the hydro mechanical machine.

The hydraulic pump 132 may supply the fluid to the rotary control valve 108 or the boom control valve 154, in parallel to the primary pump system 104. In an embodiment, a check valve 136 may be provided in parallel to the supply line of the hydraulic motor 134. The check valve 136 may prevent cavitation of the hydraulic motor 134, when there is scarcity of fluid supply from the primary accumulator 114. The secondary pump system 130 may further include a flow control valve 172 in a line supplying fluid from the direction control valve 124 to the hydraulic motor 134, to regulate the fluid supply. The flow control valve 172 may be operated by any electronic signal. It should be noted that the flow control valve 172 may be a fixed setting type, a proportional control type, a temperature compensated type, a pressure compensated type control valve in order to provide constant fluid flow, or a physical parameter compensation type. Examples of physical parameter may include, but are not limited to density, viscosity, or pressure variation. Further, the flow control valve 172 may be operated electronically by switching off/on, for controlling the fluid flow to the hydraulic motor 134. This may depend upon sensing of pressure of fluid by a first pressure transducer 140 in the primary accumulator 114. Further, the flow control may be provided independent of variation in density, viscosity or any other physical property.

In the secondary pump system 130, the hydraulic pump 132 and hydraulic motor 134 (as depicted in FIG. 1) are of fixed displacement type. However, it will be apparent to a person skilled in the art that the hydraulic pump 132 and the hydraulic motor 134 may be of variable displacement type or any other variation thereof. This enables recovery of hydraulic power independent of variation in load pressure of the rotary mechanism 102, the boom cylinder 158, the other actuators, or a supply pressure of the primary pump system 104. According to an embodiment, it is not necessary that a hydraulic system for hydro mechanical machine comprising rotary mechanism should have both direct supply of the fluid and a secondary system for supply of stored fluid from the primary accumulator 114. It may be possible that the hydraulic system includes only direct fluid supply from the primary accumulator 114 to outlet of the primary pump system 104, the secondary pump system 130 or to a combination of both. The secondary pump system 130 may be used when there is a need to increase the pressure of the fluid of the primary accumulator 114 to a higher pressure. The secondary pump system 130 provides a sufficient high fluid pressure to connected mechanisms and actuators which demand a high fluid pressure.

In the hydraulic supply circuit 100, a secondary accumulator 138 may be provided in the line supplying fluid from the hydraulic pump 132 to the rotary control valve 108. The secondary accumulator 138 may be provided near a junction of the primary pump system 104 to reduce pressure fluctuations due to variation in demand of fluid flow by the rotary mechanism 102, the boom cylinder 158, other connected hydraulic actuators and supply of fluid from the primary accumulator 114. In an embodiment, when the opening in the rotary control valve 108, the boom control valve 154 or the other control valves is closed as a result of a stop command applied by their respective controllers such as the swing controller 110, and the boom controller 156 and secondary pump system 30 keeps on supplying the fluid due to inertia, the excess fluid is stored in the secondary accumulator 138. In a similar manner, during sudden or immediate start of the rotary mechanism 102, the boom cylinder 158 or the other connected mechanisms and opening of a supply port of the rotary control valve 108, the boom control valve 154 or the other control valves, the sudden demand flow may be supplied by the secondary accumulator 138, when there is insufficient fluid supply available from the primary pump system 104 and the secondary pump system 130

The hydraulic supply circuit 100 may include the first pressure transducer 140 that is in communication with the primary accumulator 114. The first pressure transducer 140 measures the pressure of the fluid in the primary accumulator 114 as well as indicates the measured fluid pressure to the operator along with an indication of storing or supplying the hydraulic energy by the primary accumulator 114. The hydraulic supply circuit 100 may include the second pressure transducer 174 in the suction line of the anti-cavitation valve 166, to warn the operator in case the pressure value at the inlet of anti-cavitation valves 166 falls below the predefined threshold pressure value. The pressure transducers 140, 174 and 176 may be further configured to provide a feedback to the control system 126. Further, the second pressure transducer 174 may be provided with controls to stop machine operation, if in any case, pressure at the inlet of the anti-cavitation valves 166 fall below the pre-defined threshold pressure value. The control system 126 may also get the feedback from the pressure transducers 140 and 174, the swing controller 110, the boom controller 156 and the other controllers. Based on actuation by the swing controller 110, the boom controller 156 and the feedback, the control system 126 may operate the direction control valve 124 to selectively supply fluid from the primary accumulator 114 directly to the rotary control valve 108, the boom control valve 154, or the other control valves through the secondary pump system 130.

As depicted in the hydraulic supply circuit 100, a fuel sensor 142 may also be provided in the fuel line of an engine of the hydro-mechanical machine. The fuel sensor 142 may have a digital display and may be used to measure and display the fuel consumed by the hydro mechanical machine during various operations.

When the swing controller 110 sends a command to the rotary control valve 108 to rotate in clockwise or counter-clockwise direction, the supply passage in the rotary control valve 108 is opened and the primary pump system 104 supplies fluid to the rotary control valve 108. However, initially the rotary mechanism 102 may not rotate fast enough and pressure builds up at the rotary mechanism 102. This may open the set of check valves 116, the regenerative valve 112 and may allow the excess fluid to enter the primary accumulator 114. When the swing controller 110 sends a stop command to the rotary control valve 108, the fluid passage in the rotary control valve 108 is closed. However, the rotary mechanism 102 keeps on rotating due to inertia, and thus acts as pump thereby supplying fluid under high pressure. The fluid, owing to the high pressure, opens the set of check valves 116, the regenerative valve 112 and passes the high-pressure fluid to enter the primary accumulator 114.

When the swing controller 110 applies rotation command and the primary accumulator 114 is sufficiently charged because of the fluid, the pressure of fluid in supply line of the rotary control valve 108 or the boom control valve 154 may be less than the pressure of fluid in the primary accumulator 114, by more than 5-7 bar. In this scenario, as the direction control valve 124 opens, the fluid is supplied by opening of the check valve 128 and the check valve 146 in a free flow direction. The fluid is supplied by the primary accumulator 114 and pressure difference across the check valve 146 becomes positive. In other words, upstream pressure is more than downstream pressure across the check valve 146. In this scenario, the supply feedback from the flow sensing arrangement 122 is fed to the pump controller 120 in order to reduce displacement and thereby flow from the primary pump system 104 by an amount which is same as the amount of fluid flow supplied through the check valve 146.

The pressure of the fluid in the supply line of the rotary control valve 108 or the boom control valve 154 may be equal to or more than the pressure of the fluid in the primary accumulator 114. In this scenario, the direction control valve 124 opens, however, the fluid is not able to flow by opening of the check valve 128 in free flow direction, owing to less pressure of the fluid. Thus, in such a case, fluid is supplied to the hydraulic motor 134, which converts medium pressure hydraulic energy of the fluid into mechanical energy and drives the hydraulic pump 132 coupled to the hydraulic motor 134. The displacement of the hydraulic pump 132 may be less than the displacement of the hydraulic motor 134 in accordance with a predefined proportion. Conformance with the predefined proportion increases pressure of oil supplied by the hydraulic pump 132, so that the pressure is sufficient enough to feed to the rotary control valve 108, the boom control valve 154 or to the other control valves. The hydraulic pump 132 converts the mechanical energy into high pressure of the fluid that opens the check valve 146 and supplies fluid to the rotary control valve 108 or the boom control valve 154. The hydraulic motor 134 and the hydraulic pump 132 may be fixed displacement type or variable displacement type.

Thus, the secondary pump system 130, which is the combination of the hydraulic motor 134 and the hydraulic pump 132, converts medium pressure energy of the fluid received from the primary accumulator 114 to high pressure energy of the fluid. As the fluid is supplied by the secondary pump system 130, the difference of pressure across the check valve 146 may become positive. In other words, upstream fluid pressure is more than downstream fluid pressure across the check valve 146. In this case, the flow sensing arrangement 122 feeds the supply feedback to the pump controller 120. In response, the pump controller 120 reduces displacement and thereby flow rate from the primary pump system 104 by an amount which is same as fluid supplied through the check valve 146. In some cases, the flow sensing arrangement 122 is not provided in the hydro-mechanical machine, and also the primary accumulator 114 supplies pressurized fluid. For such cases, the pump speed and engine speed may be reduced to reduce the flow of the primary pump system 104. According to some embodiments, when the rotary control valve 108 and boom control valve 154 are not limiting the maximum flow of the primary pump system 104 the power consumption or fuel consumption may be reduced by reducing speed of engine which drives it. Since, the primary accumulator 114 is supplying stored hydraulic fluid, the primary pump system 104 need not run at same high speed. And, the engine speed driving pump may be reduced by reducing the fuel supply by a throttle lever.

The primary accumulator 114, may supply the stored fluid during acceleration of the rotary mechanism 102, lifting of the boom cylinder 158 or based on actuations of other mechanisms. It will be apparent to the person skilled in the art, that the stored high-pressure fluid from primary accumulator 114 may be supplied to the different actuators, the set of shuttle valves 148 and 170, the set of flow restrictors 150 and 168, and the direction control valve 124.

Various embodiments provide a hydraulic system for hydro-mechanical machines comprising a rotary mechanism, a boom cylinder and other mechanisms. The hydraulic system includes a primary pump system to supply a fluid from a fluid reservoir to the rotary mechanism, and boom cylinder through a rotary control valve and boom control valve, respectively. The hydraulic system further includes a primary accumulator, a control system, and a pump controller. The primary accumulator, receives and selectively stores a high-pressure fluid from the rotary mechanism during acceleration and de-acceleration.

The control system controls the supply of fluid from the primary accumulator to the rotary control valve, the boom control valve, or other control valves through a hydraulic supply circuit. The hydraulic system is such that, when the swing controller or the boom controller is operated to rotate the rotary mechanism or for lifting the boom cylinder, the hydraulic supply circuit enables passage of the high-pressure fluid from the primary accumulator directly to the rotary control valve or the boom control valve through a direction control valve, when the pressure in a fluid supply line of the rotary control valve, the boom control valve or the other control valves is less than the pressure of the fluid in the primary accumulator. However, the hydraulic supply circuit enables passage of the high-pressure fluid from the primary accumulator to the rotary control valve through a secondary pump system, when the pressure in a fluid supply line of the rotary control valve, the boom control valve, or the other control valves is equal to or more than the pressure of the fluid in the primary accumulator. The primary accumulator supplies hydraulic fluid parallel to primary pump and the pump controller controls the output of the primary pump system based on fluid flow supply to the rotary control valve, the boom control valve, or the other control valves.

Thus, the hydraulic system recovers the energy, which is wasted during starting and stopping of a rotary mechanism in a hydro-mechanical machine, by converting the energy into hydraulic potential energy. This energy is then reused to improve productivity and fuel efficiency of the hydro-mechanical machine. One or more accumulators in the hydraulic system collect kinetic energy, which is wasted by the motion of rotary mechanism in the form of hydraulic energy. The one or more accumulators store the pressurized fluid draining from the rotary mechanism, which may be used later by the rotary mechanism, the boom cylinder or the other actuators for useful work. It will be apparent to a person skilled in the art that the hydraulic system may be applicable to any type of rotating bodies or machines where the hydraulic or kinetic energy is lost while accelerating/starting or de-accelerating/stopping.

In the drawings and specification there has been set forth preferred embodiments of the invention, and although specific terms are employed, these are used in a generic and descriptive sense only and not for purposes of limitation. Changes in the form and the proportion of parts, as well as in the substitution of equivalents, are contemplated as circumstances may suggest or render expedient without departing from the spirit or scope of the invention.

The illustrated steps are set out to explain the exemplary embodiments shown, and it should be anticipated that ongoing technological development will change the manner in which particular functions are performed. These examples are presented herein for purposes of illustration, and not limitation. Alternatives (including equivalents, extensions, variations, deviations, etc., of those described herein) will be apparent to persons skilled in the relevant art(s) based on the teachings contained herein. Such alternatives fall within the scope and spirit of the disclosed embodiments.

It is intended that the disclosure and examples be considered as exemplary only, with a true scope and spirit of disclosed embodiments being indicated by the following claims.

What is claimed is:

1. A hydraulic system for a hydro-mechanical machine comprising a rotary mechanism and a boom cylinder, the hydraulic system comprising:

a primary accumulator configured to receive and store high-pressure fluid in response to starting and stopping of the rotary mechanism;

a control system coupled to the primary accumulator through a hydraulic supply circuit, wherein the control system is configured to enable passage of the high-pressure fluid stored in the primary accumulator to a rotary control valve operated by a swing controller configured to control the rotary mechanism, a boom control valve operated by a boom controller configured to control the boom cylinder through the hydraulic supply circuit, based on a predefined pressure threshold associated with the primary accumulator;

a direction control valve configured to enable passage of the high-pressure fluid from the primary accumulator to the rotary control valve, the rotary mechanism, the boom control valve, and the boom cylinder in the hydraulic supply circuit, based on initiation or control by at least one of the swing controller, the boom controller and commanded by the control system, when pressure in a fluid supply line of the rotary control valve or the boom control valve is less than the pressure of the high-pressure fluid in the primary accumulator;

wherein the swing controller and the boom controller commanded by the control system are further configured to enable passage of the high-pressure fluid from the primary accumulator to the rotary control valve, the boom control valve, or to control valves of the hydro mechanical machine, through a secondary pump system in the hydraulic supply circuit, when pressure in a fluid supply line of the rotary control valve or the boom control valve is greater than or equal to the fluid pressure in the primary accumulator;

wherein the secondary pump system comprises:

a hydraulic motor configured to convert hydraulic energy of the fluid from the primary accumulator into mechanical energy;

a hydraulic pump coupled to the hydraulic motor, wherein the hydraulic motor drives the hydraulic pump, wherein each of the hydraulic motor and the hydraulic pump is one of a fixed displacement type and a variable displacement type; and a flow control valve in a line supplying fluid from the direction control valve to the hydraulic motor of the secondary pump system, to regulate the fluid supply, wherein the flow control valve is one of a fixed setting type, a variable setting type, an electronic control type, a temperature compensated type, or a physical parameter compensation type; and a secondary accumulator coupled to the primary accumulator and operated by at least one of the swing controller and the boom controller and commanded via the control system and the hydraulic supply circuit, wherein the secondary accumulator is configured to store surplus high-pressure fluid provided by the primary accumulator through the hydraulic supply circuit.

2. The hydraulic system of claim 1, wherein the secondary accumulator is further configured to:

store the surplus high-pressure fluid supplied by the primary accumulator; and supply the surplus high-pressure fluid to the rotary control valve, the rotary mechanism, the boom control valve, and the boom cylinder.

3. The hydraulic system of claim 1, further comprising a pump controller configured to:

adapt output of the primary pump system coupled to the rotary control valve and the boom control valve based on supply of the high-pressure fluid from the primary accumulator, wherein the primary pump system is further configured to supply fluid from a fluid reservoir to the rotary control valve and the boom control valve; and vary displacement of the primary pump system based on at least one of: actuation of the swing controller, actuation of the boom controller, sensing of outlet pressure of the primary pump system, fluid flow required by the rotary mechanism and the boom cylinder, or available fluid supply from the primary accumulator.

4. The hydraulic system of claim 1, further comprising a flow sensing arrangement in a line supplying fluid from the primary accumulator to the rotary control valve and the boom control valve, wherein the flow sensing arrangement provides fluid supply feedback to the primary pump system in order to reduce displacement and flow from the primary pump system by an amount equal to an amount of fluid flow supplied by the primary accumulator.

5. The hydraulic system of claim 1, further comprises a pressurized tank at a line connecting inlet of anti-cavitation valves to a tank line of the rotary control valve, the boom control valve, and the other control valves of the hydro mechanical machine for providing positive suction pressure, wherein the pressurized tank is comprises at least one of an accumulator, a charging pump, a positive displacement type pump, a centrifugal pump, a fluid source, a metallic flexible bellow, or a wired braided elastomer bellow, at the line connecting inlet of the anti-cavitation valves to the tank line of the rotary control valve, the boom control valve, and the other control valves of the hydro mechanical machine for providing positive suction pressure, and wherein each of the metallic flexible bellow and the wired braided elastomer bellow expand to hold fluid under high pressure and contract to release fluid in response to demand by the rotary mechanism.

6. The hydraulic system of claim 1, further comprising a regenerative valve in one of a series combination or a parallel combination at ports of the rotary mechanism in order to divert high-pressure fluid to the primary accumulator, while starting or stopping the rotary mechanism.

7. The hydraulic system of claim 5, further comprises two pressure transducers and, wherein a first pressure transducer is configured to measure pressure in the primary accumulator, and a second pressure transducer present in a suction line of the anti-cavitation valves is configured to measure and indicate suction line pressure, and wherein the second pressure transducer alerts an operator, when a suction line pressure value falls below a pre-defined threshold pressure value.

8. The hydraulic system of claim 1, wherein the control system further comprises a set of shuttle valves and a set of flow restrictors in pilot sensing lines to the direction control valve, wherein the set of flow restrictors controls the fluid flow independent of variation in temperature of the fluid.

9. A hydraulic system for a hydro-mechanical machine comprising a rotary mechanism and a boom cylinder, the hydraulic system comprising:

a primary accumulator configured to:

receive high-pressure fluid in response to starting and stopping of the rotary mechanism;

temporarily store the high-pressure fluid; and provide the high-pressure fluid to a rotary control valve configured to control the rotary mechanism, and to a boom control valve configured to control the boom cylinder through a hydraulic supply circuit, based on a predefined pressure threshold associated with the primary accumulator;

a control system coupled to the primary accumulator through a hydraulic supply circuit;

a swing controller and a boom controller commanded by the control system are configured to enable passage of the high-pressure fluid from the primary accumulator to the rotary control valve, the boom control valve, or to control valves of the hydro mechanical machine, through a secondary pump system in the hydraulic supply circuit, when pressure in a fluid supply line of the rotary control valve or the boom control valve is greater than or equal to fluid pressure in the primary accumulator;

a direction control valve configured to enable passage of the high-pressure fluid from the primary accumulator to the rotary control valve, the rotary mechanism, the boom control valve, and the boom cylinder in the hydraulic supply circuit, based on initiation or control by at least one of the swing controller, the boom controller and commanded by the control system, when pressure in a fluid supply line of the rotary control valve or the boom control valve is less than the pressure of the high-pressure fluid in the primary accumulator;

wherein the secondary pump system comprises:

a hydraulic motor configured to convert hydraulic energy of the fluid from the primary accumulator into mechanical energy;

a hydraulic pump coupled to the hydraulic motor, wherein the hydraulic motor drives the hydraulic pump, wherein each of the hydraulic motor and the hydraulic pump is one of a fixed displacement type and a variable displacement type; and a flow control valve in a line supplying fluid from the direction control valve to the hydraulic motor of the secondary pump system, to regulate the fluid supply, wherein the flow control valve is one of a fixed setting type, a variable setting type, an electronic control type, a temperature compensated type, or a physical parameter compensation type; and a secondary accumulator coupled to the primary accumulator via the hydraulic supply circuit, wherein the secondary accumulator is configured to store surplus high-pressure fluid provided by the primary accumulator in the hydraulic supply circuit.

10. The hydraulic system of claim 9, wherein the secondary accumulator is further configured to:

store the surplus high-pressure fluid supplied by the primary accumulator; and supply the surplus high-pressure fluid to the rotary control valve, the rotary mechanism, the boom control valve, and the boom cylinder.

11. A hydraulic system for an off-highway machine comprising a swing motor and a boom cylinder, the hydraulic system comprising:

a primary accumulator configured to receive and store high-pressure fluid in response to starting and stopping of the swing motor;

a control system, via a swing controller, coupled to the primary accumulator through a hydraulic supply circuit, wherein the control system is operated by the swing controller and a boom controller and is configured to enable passage of the high-pressure fluid stored in the primary accumulator to a rotary control valve configured to control the swing motor, a boom control valve to control the boom cylinder through the hydraulic supply circuit, based on a predefined pressure threshold associated with the primary accumulator;

a direction control valve configured to enable passage of the high-pressure fluid from the primary accumulator to the rotary control valve, the swing motor, the boom control valve, and the boom cylinder in the hydraulic supply circuit, based on initiation or control by at least one of the swing controller, the boom controller and commanded by the control system, when pressure in a fluid supply line of the rotary control valve or the boom control valve is less than the pressure of the high-pressure fluid in the primary accumulator;

wherein the swing controller and the boom controller commanded by the control system are further configured to enable passage of the high-pressure fluid from the primary accumulator to the rotary control valve, the boom control valve, or to control valves of the hydraulic mechanical machine, through a secondary pump system in the hydraulic supply circuit, when pressure in a fluid supply line of the rotary control valve or the boom control valve is greater than or equal to the fluid pressure in the primary accumulator;

wherein the secondary pump system comprises:

a hydraulic motor configured to convert hydraulic energy of the fluid from the primary accumulator into mechanical energy;

a hydraulic pump coupled to the hydraulic motor, wherein the hydraulic motor drives the hydraulic pump, wherein each of the hydraulic motor and the hydraulic pump is one of a fixed displacement type and a variable displacement type; and a flow control valve in a line supplying fluid from the direction control valve to the hydraulic motor of the secondary pump system, to regulate the fluid supply, wherein the flow control valve is one of a fixed setting type, a variable setting type, an electronic control type, a temperature compensated type, or a physical parameter compensation type; and a secondary accumulator coupled to the primary accumulator and the control system via the hydraulic supply circuit, wherein the secondary accumulator is configured to store surplus high-pressure fluid provided by the primary accumulator through the hydraulic supply circuit.

12. The hydraulic system for an off-highway machine of claim 11, wherein the swing controller, the boom controller, and the control system are further configured to enable passage of the high-pressure fluid from the primary accumulator directly to the rotary control valve and the boom control valve through the direction control valve and a check valve in the hydraulic supply circuit, when pressure in a fluid supply line of the rotary control valve or the boom control valve is less than the pressure of the high-pressure fluid in the primary accumulator.

13. The hydraulic system for an off-highway machine of claim 11, wherein the secondary accumulator is further configured to:

store the surplus high-pressure fluid supplied by the primary accumulator; and supply the surplus high-pressure fluid to the rotary control valve, the swing motor, the boom control valve and the boom cylinder.

14. The hydraulic system for an off-highway machine of claim 11, further comprising a pump controller configured to:

adapt output of a primary pump system coupled to the rotary control valve and boom control valve based on supply of the high-pressure fluid from the primary accumulator, wherein the primary pump system is further configured to supply fluid retrieved from a fluid reservoir to the rotary control valve and the boom control valve; and vary displacement of the primary pump system based on at least one of: actuation of the swing controller or the boom controller, sensing of outlet pressure of the primary pump system, fluid flow required by the swing motor, and available fluid supply from the primary accumulator.

15. The hydraulic system for an off-highway machine of claim 11, further comprising a flow sensing arrangement in the line supplying fluid from the primary accumulator to the rotary control valve and the boom control valve, wherein the flow sensing arrangement provides oil supply feedback to the primary pump system in order to reduce displacement and flow from the primary pump system by an amount equal to an amount of fluid flow supplied by the primary accumulator.

* * * * *